US012522983B2

(12) United States Patent
Weatherill et al.

(10) Patent No.: US 12,522,983 B2
(45) Date of Patent: Jan. 13, 2026

(54) CORDLESS RAILROAD SPIKE PULLER

(71) Applicant: Epiroc Industrial Tools and Attachment LLC, Delhi, IA (US)

(72) Inventors: Jeffery Weatherill, Portland, OR (US); Balakumaran Gopalarethinam, Portland, OR (US); Brice Helm, Portland, OR (US)

(73) Assignee: Epiroc Industrial Tools and Attachment LLC, Delhi, IA (US)

( * ) Notice: Subject to any disclaimer, the term of this patent is extended or adjusted under 35 U.S.C. 154(b) by 692 days.

(21) Appl. No.: 17/493,338

(22) Filed: Oct. 4, 2021

(65) Prior Publication Data

US 2022/0282431 A1 Sep. 8, 2022

Related U.S. Application Data

(60) Provisional application No. 63/155,610, filed on Mar. 2, 2021.

(51) Int. Cl.
*E01B 29/26* (2006.01)

(52) U.S. Cl.
CPC ..... *E01B 29/26* (2013.01)

(58) Field of Classification Search
CPC ..... E01B 29/26
See application file for complete search history.

(56) References Cited

U.S. PATENT DOCUMENTS

| | | | |
|---|---|---|---|
| 728,096 | A | 5/1903 | Giltner |
| 1,600,130 | A | 9/1926 | Ochs |
| 2,424,681 | A | 7/1947 | Eberhart |

(Continued)

FOREIGN PATENT DOCUMENTS

| | | | |
|---|---|---|---|
| CA | 2969795 | A1 | 12/2017 |
| CN | 110670428 | A | 1/2020 |

(Continued)

OTHER PUBLICATIONS

International Search Report and Written Opinion regarding International Patent Application No. PCT/US2022/018329, dated Jul. 7, 2022.

(Continued)

*Primary Examiner* — Nirvana Deonauth
(74) *Attorney, Agent, or Firm* — Harness, Dickey & Pierce, P.L.C.

(57) ABSTRACT

A control circuit can be operably coupled to the drive motor, a manually actuatable trigger switch. A pull rod position sensor can be coupled to the control circuit. The pull rod position sensor can be operable to provide at least one of an extended position signal to the control circuit in response to the non-rotating pull rod and the spike puller jaws being in the extended position, and a retracted position signal to the control circuit in response to the non-rotating pull rod and the spike puller jaws being in the retracted position. A pair of operating handles can each have an operating manual gripping portion for ergonomically operating the spike puller in an upright operating orientation. A pair of carrying handles can each include a carrying manual gripping portion oriented for ergonomically carrying the spike puller in a side-laying carrying orientation that borders an opening through the plastic housing.

14 Claims, 9 Drawing Sheets

(56) References Cited

U.S. PATENT DOCUMENTS

| | | | | |
|---|---|---|---|---|
| 2,639,887 | A | 5/1953 | Henry | |
| 2,706,103 | A | 4/1955 | Stambaugh et al. | |
| 2,796,232 | A | 6/1957 | Steffanus | |
| 2,797,889 | A | 7/1957 | Talboys | |
| 2,900,169 | A | 8/1959 | White | |
| 3,008,226 | A | 11/1961 | Kellerman | |
| 3,643,918 | A | 2/1972 | Ellis | |
| 4,642,866 | A | 2/1987 | Murtaugh | |
| 4,769,890 | A | 9/1988 | Maynard | |
| 5,033,180 | A | 7/1991 | Colson | |
| 5,924,679 | A | 7/1999 | Wilson | |
| 6,098,960 | A | 8/2000 | Lefavour et al. | |
| 6,113,073 | A | 9/2000 | Lefavour et al. | |
| 6,910,252 | B2 | 6/2005 | Draggie et al. | |
| 7,658,368 | B2 | 2/2010 | Laun | |
| 8,978,221 | B1 | 3/2015 | Somerville et al. | |
| 9,145,648 | B2 | 9/2015 | Crover | |
| 9,637,867 | B2 | 5/2017 | Burns | |
| 10,597,828 | B2 | 3/2020 | Benjamin et al. | |
| 11,131,066 | B2 * | 9/2021 | Benjamin | E01B 29/26 |
| 11,131,067 | B2 | 9/2021 | Benjamin et al. | |
| 11,208,767 | B2 | 12/2021 | Benjamin et al. | |
| 2004/0187284 | A1 | 9/2004 | Draggie et al. | |
| 2009/0236572 | A1 | 9/2009 | Laun | |
| 2011/0067528 | A1 | 3/2011 | Price | |
| 2011/0131783 | A1 | 6/2011 | Betcher et al. | |
| 2011/0278513 | A1 | 11/2011 | Esposito | |
| 2013/0276300 | A1 | 10/2013 | Cha et al. | |
| 2014/0166323 | A1 * | 6/2014 | Cooper | F16P 3/147 173/176 |
| 2016/0023873 | A1 | 1/2016 | Kasan | |
| 2017/0350078 | A1 | 12/2017 | Benjamin et al. | |
| 2020/0032461 | A1 | 1/2020 | Widlroither | |
| 2020/0141064 | A1 | 5/2020 | Benjamin et al. | |
| 2020/0173116 | A1 | 6/2020 | Benjamin et al. | |
| 2020/0173117 | A1 | 6/2020 | Benjamin et al. | |

FOREIGN PATENT DOCUMENTS

| | | | |
|---|---|---|---|
| DE | 102004048681 | A1 | 4/2006 |
| EP | 0276553 | A1 | 8/1988 |
| EP | 2939791 | A1 | 11/2015 |
| EP | 3255207 | A1 | 12/2017 |
| EP | 3255207 | B1 | 12/2019 |
| EP | 3653790 | A1 | 5/2020 |
| EP | 3677725 | A1 | 7/2020 |
| GB | 168101 | A | 9/1921 |
| GB | 282234 | A | 12/1927 |
| GB | 794433 | A | 5/1958 |
| GB | 2484958 | A | 5/2012 |
| JP | S50056291 | U | 5/1975 |
| JP | S5555377 | U | 4/1980 |
| JP | 2011-104707 | A | 6/2011 |
| JP | 2013-151041 | A | 8/2013 |
| JP | 2015-020219 | A | 2/2015 |
| JP | 2015-147287 | A | 8/2015 |
| RU | 2374379 | C1 | 11/2009 |
| WO | WO-2019095018 | A1 | 5/2019 |

OTHER PUBLICATIONS

Partial European Search Report corresponding to European Application No. 22159356.9-1005 dated Jun. 13, 2022, 11 pages.

Extended European Search Report corresponding to European Application No. 22159356.9-1005, dated Sep. 13, 2022.

Spectrasymbol HotPot HP, Rev F2, pp. 1-5, spectrasymbol.com., as retrieved from the internet in 2016 at https://www.spectrasymbol.com/wp-content/uploads/2016/12/HOTPOT-DATA-SHEET-Rev-F2.pdf.

Stanley SPL31 Hydraulic Spike Puller, User Manual, Dec. 2018 Ver. 12.

Stanley SPL31 Hydraulic Spike Puller, User Manual, Oct. 2017 Ver. 11.

Stanley SPL31A Lightweight Hydraulic Spike Puller, 2017 or earlier.

Electric Rod Actuators vs. Hydraulic Cylinders, Aaron Dietrich, Tolomatic, 2017.

What are the main types of linear actuators? Danielle Collins, Mar. 3, 2016, https://www.linearmotiontips.com/main-types-linear-actuators/.

Electric rod actuators vs. hydraulic cylinders: A comparison of the pros and cons of each technology, Aaron Dietrich, Tolomatic, 2016.

Jena Tec, Ballscrew Linear Actuators catalogue, Issue: Nov. 2005.

What's the Difference Between Pneumatic, Hydraulic, and Electrical Actuators?, Carlos Gonzales, Apr. 16, 2015, https://www.machinedesign.com/mechanical-motion-systems/linear-motion/article/21832047/whats-the-difference-between-pneumatic-hydraulic-and-electrical-actuators.

The Major Types of Linear Actuators, Digital Connect Mag, 2016, https://www.digitalconnectmag.com/the-major-types-of-linear-actuators/.

18942ET Brochure, ET Series Electric Cylinders, Parker Hannifin Corporation, May 16, 2016, https://web.archive.org/web/20160516224804/https://www.parkermotion.com/actuator/18942ET.pdf.

18942ET Brochure, ET Series Electric Cylinders, Parker Hannifin Corporation, Jun. 12, 2013, https://web.archive.org/web/20130612010949/https://www.parkermotion.com/actuator/18942ET.pdf.

AutomationWorld, Tolomatic, "Your Motor Here" Program Includes Newest Rod-Style and Guided Actuators, Jan. 7, 2011, https://www.automationworld.com/products/control/article/13297620/your-motor-here-program-includes-newest-rodstyle-and-guided-actuators.

Making a Powerful Linear Actuator, Makezilla.com, Jan. 26, 2016, https://makezilla.com/2016/01/26/making-a-powerful-linear-actuator/.

How to make a linear actuator, YouTube.com, May 24, 2017, <https://www.youtube.com/watch?v=RZtMHKzvLaU>.

* cited by examiner

CORDLESS RAILROAD SPIKE PULLER

CROSS-REFERENCE TO RELATED APPLICATIONS

This application claims the benefit of U.S. Provisional Application No. 63/155,610, filed on Mar. 2, 2021. The entire disclosure of the above application is incorporated herein by reference.

FIELD

The present disclosure relates to a cordless spike puller for pulling out rail spikes of a railroad track.

BACKGROUND

This section provides background information related to the present disclosure which is not necessarily prior art.

Spike pullers have generally been drive by hydraulic power in the past. These tools are heavy and typically require hydraulic hoses to connect them to a hydraulic power source. This presents difficulties in using the tool in remote areas where railroad tracks are often found.

Although a few battery powered spike pullers are known, there is a need for various improvements to these initial attempts. As two examples, there is a need to increase operator comfort, a need to reduce physical and mental operator fatigue, and to increase operator productivity with these tools.

SUMMARY

This section provides a general summary of the disclosure, and is not a comprehensive disclosure of its full scope or all of its features.

In one aspect of the present disclosure, a cordless railroad spike puller can include a drive motor and a threaded drive shaft with a gear train operably coupling the drive motor to the threaded drive shaft. Spike puller jaws can have a non-rotating pull rod that couples the threaded drive shaft to the spike puller jaws. A battery mount can be selectively couplable to a rechargeable battery to provide electric power to the drive motor. Rotation of the drive motor in a forward direction can rotate the gear train and the threaded drive shaft to move the non-rotating pull rod and the spike puller jaws toward a retracted position within the cordless railroad spike puller. Rotation of the drive motor in a reverse direction can rotate the gear train and the threaded drive shaft to move the non-rotating pull rod and the spike puller jaws toward an extended position within the cordless railroad spike puller. A control circuit can be operably coupled to the drive motor, a manually actuatable trigger switch, and a pull rod position sensor can be coupled to the control circuit. The pull rod position sensor can be operable to provide at least one of an extended position signal to the control circuit in response to the non-rotating pull rod and the spike puller jaws being in the extended position, and a retracted position signal to the control circuit in response to the non-rotating pull rod and the spike puller jaws being in the retracted position.

In other aspects of the present disclosure, the gear train can be a non-impact gear train. The control circuit can be configured to operate the drive motor in the forward direction at a spike grasping motor speed during a spike grasping phase in response to an "on" signal from the manually actuatable trigger switch. The control circuit can be configured to operate the drive motor in the forward direction at a spike pulling motor speed, which is faster than the spike grasping motor speed, during a spike pulling phase upon completion of the spike grasping phase. The pull rod position sensor can be operable to provide a speed change signal to the control circuit in response to the non-rotating pull rod moving a predetermined grasping distance from the extended position that is sufficient for the spike puller jaws to seat around and grab a railroad spike. The control circuit can be configured to operate the drive motor in the forward direction at the spike pulling motor speed in response to the speed change signal from the pull rod position sensor. The control circuit can be configured to operate the drive motor in the reverse direction at a return motor speed, which is faster than the spike grasping motor speed, during an automatic return phase in which the non-rotating pull rod and the spike puller jaws move toward the extended position, upon completion of the spike pulling phase.

In other aspects of the present disclosure, the control circuit can be configured to operate the drive motor in the reverse direction at a return motor speed during an automatic return phase in which the non-rotating pull rod and the spike puller jaws move toward the extended position. The control circuit can be configured to operate the drive motor in the reverse direction at the return motor speed during the automatic return phase in response to the pull rod position sensor providing the retracted position signal to the control circuit. The control circuit can be configured to operate the drive motor in the reverse direction at the return motor speed during the automatic return phase in response to the manually actuatable trigger switch providing an "off" signal to the control circuit. The control circuit can be configured to turn the drive motor "off," ending the automatic return phase, in response to the pull rod position sensor providing the extended position signal to the control circuit. The control circuit is configured to ignore any signal from the manually actuatable trigger switch during the automatic return phase.

In other aspects of the present disclosure, the gear train can include a dual speed gear train having a high speed gear path, and a low speed gear path. A manually actuatable gear speed switch can be operably coupled to the dual speed gear train to selectively drivingly couple the drive motor to the threaded drive shaft through the high speed gear path in a high speed switch position, and to selectively drivingly couple the drive motor to the threaded drive shaft through the low speed gear path in a low speed switch position. A plurality of separate sensors can comprise the pull rod position sensor. The plurality of separate sensors can include a retracted position sensor, an extended position sensor, and a speed change position sensor.

In other aspects of the present disclosure, a single sensor can comprise the pull rod position sensor. The single sensor can include a sensor body that can extend longitudinally along an interior surface of the cordless railroad spike puller, and a wiper that can be coupled to the non-rotating pull rod and that can extend to move along a longitudinal path of wiper engagement with the sensor body as the non-rotating pull rod moves between the extended position and the retracted position.

In another aspect of the present disclosure, a cordless railroad spike puller can include a drive motor and a threaded drive shaft operably coupled to the drive motor. Spike puller jaws can have a pull rod that can couple the threaded drive shaft to the spike puller jaws. A rechargeable battery can be operable to provide electric power to the drive motor. Rotation of the drive motor in a forward direction can rotate the threaded drive shaft to move the pull rod and the spike puller jaws toward a retracted position within the cordless railroad spike puller. Rotation of the drive motor in a reverse direction can rotate the threaded drive shaft to move the spike puller jaws toward an extended position within the cordless railroad spike puller. A manually actuatable trigger switch can be coupled to a housing that comprises a plastic material. The housing includes a pair of operating handles and each operating handle can include an operating manual gripping portion that is oriented and designed to enable a user to ergonomically operate the manually actuatable trigger switch while supporting the cordless railroad spike puller during a spike pulling operation in an operating orientation in which the threaded drive shaft and the pull rod extend in an upright operating direction. The housing can include a pair of carrying handles, and each carrying handle can include a carrying manual gripping portion that is oriented and designed to enable a user to ergonomically carry the cordless railroad spike puller in a carrying orientation in which the threaded drive shaft and the pull rod extend in a side-laying carrying direction.

In other aspects of the present disclosure, each carrying manual gripping portion of the pair of carrying handles can border an opening that extends through the plastic material of the housing. The plastic material of the housing can fully surround each of the openings that each carrying manual gripping portion of the pair of carrying handles borders. Each carrying manual gripping portion of the pair of carrying handles and each operating manual gripping portion of the pair of operating handles can border an opening that extends through the plastic material of the housing. The plastic material of the housing can fully surround each opening that each carrying manual gripping portion of the pair of carrying handles and that each operating manual gripping portion of the pair of operating handles borders. Each carrying manual gripping portion of the pair of carrying handles can border one of a first pair of separate carrying openings that extend through the plastic material of the housing, and each operating manual gripping portion of the pair of operating handles can border a second pair of separate operating openings that extend through the plastic material of the housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
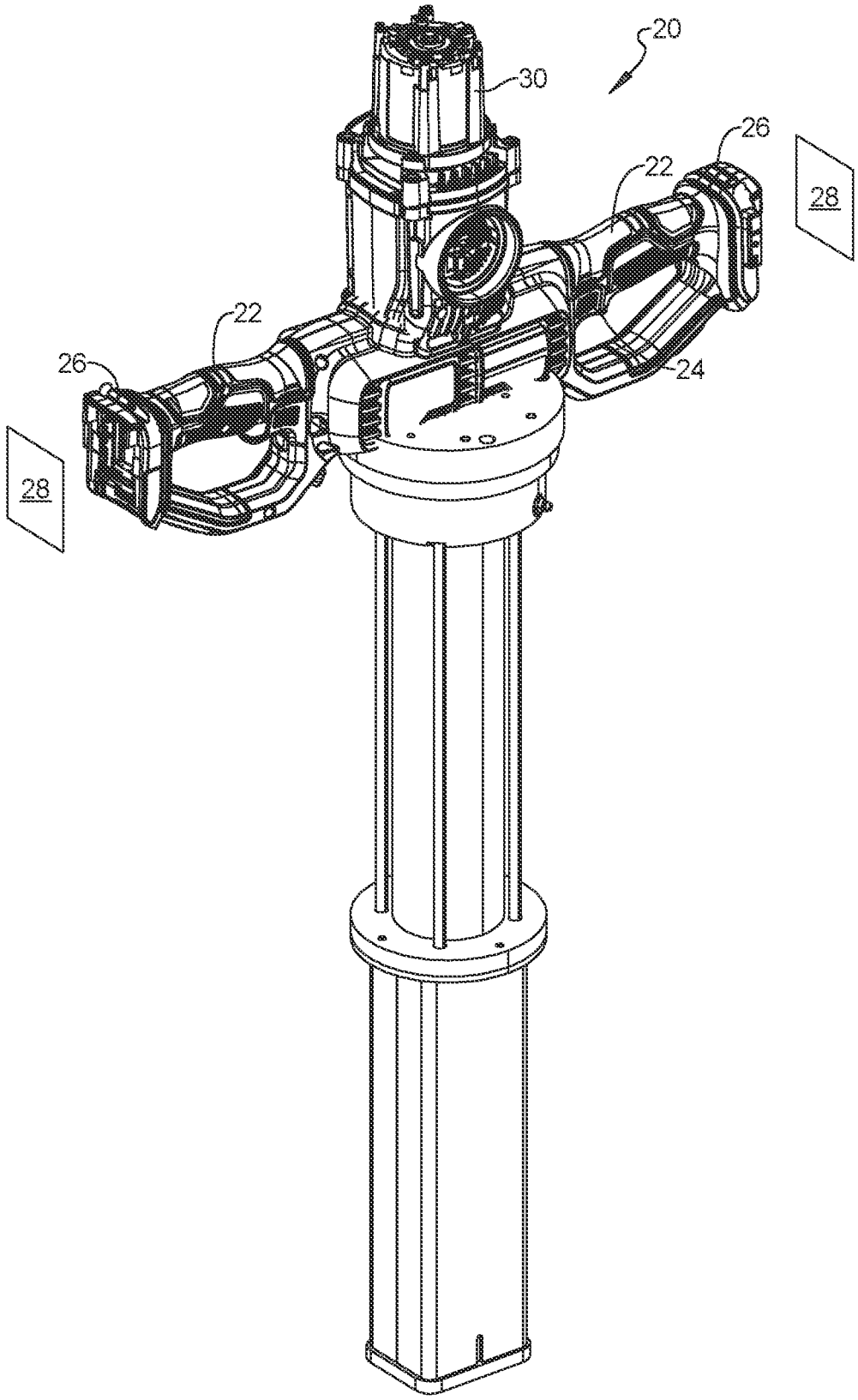
FIG. 1 is a perspective view of one example embodiment of a cordless railroad spike puller in accordance with the present disclosure.
Figure 2:
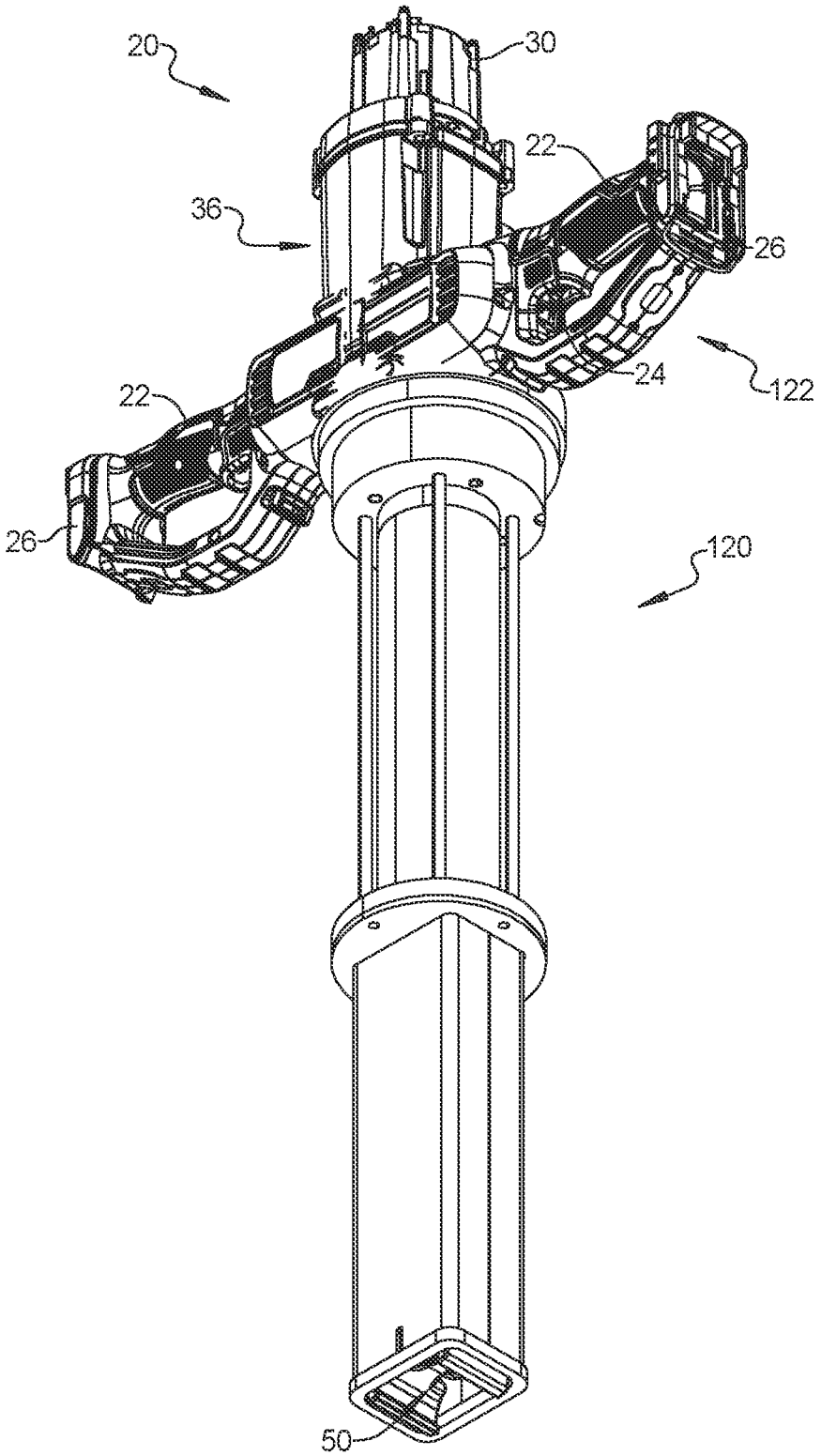
FIG. 2 is another perspective view of the example cordless railroad spike puller of FIG. 1.
Figure 3:
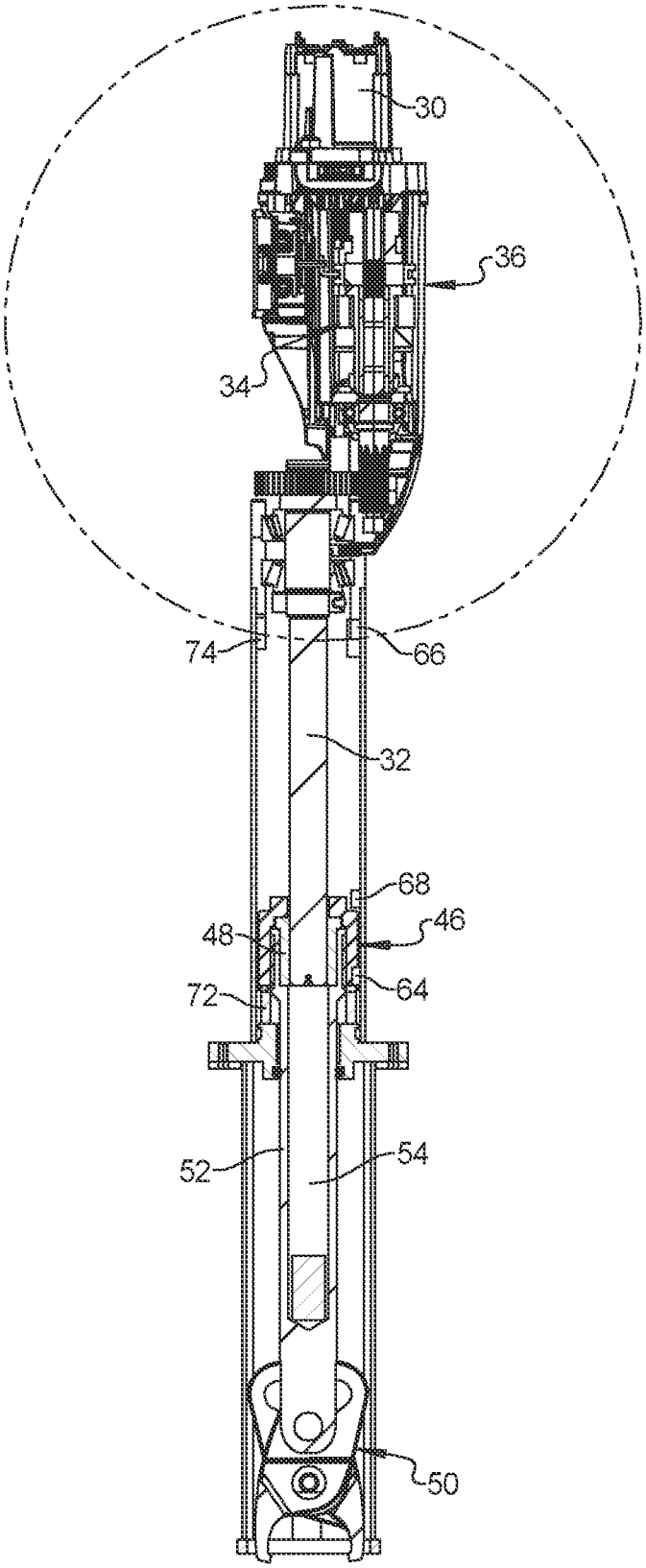
FIG. 3 is a cross-sectional view of the example cordless railroad spike puller of FIG. 1.
Figure 4:
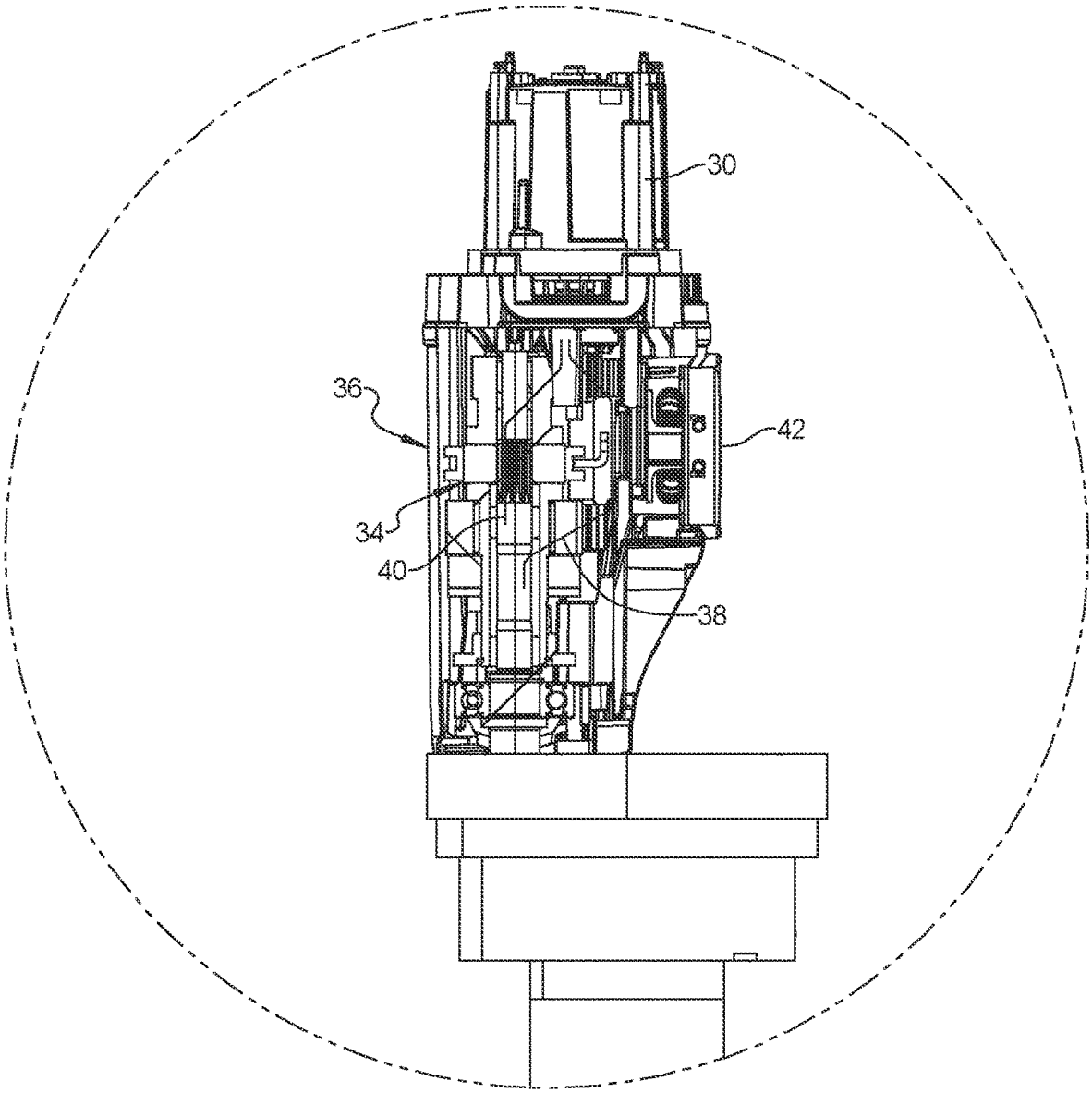
FIG. 4 is a partial cross-sectional view of the example cordless railroad spike puller of FIG. 1.
Figure 5:
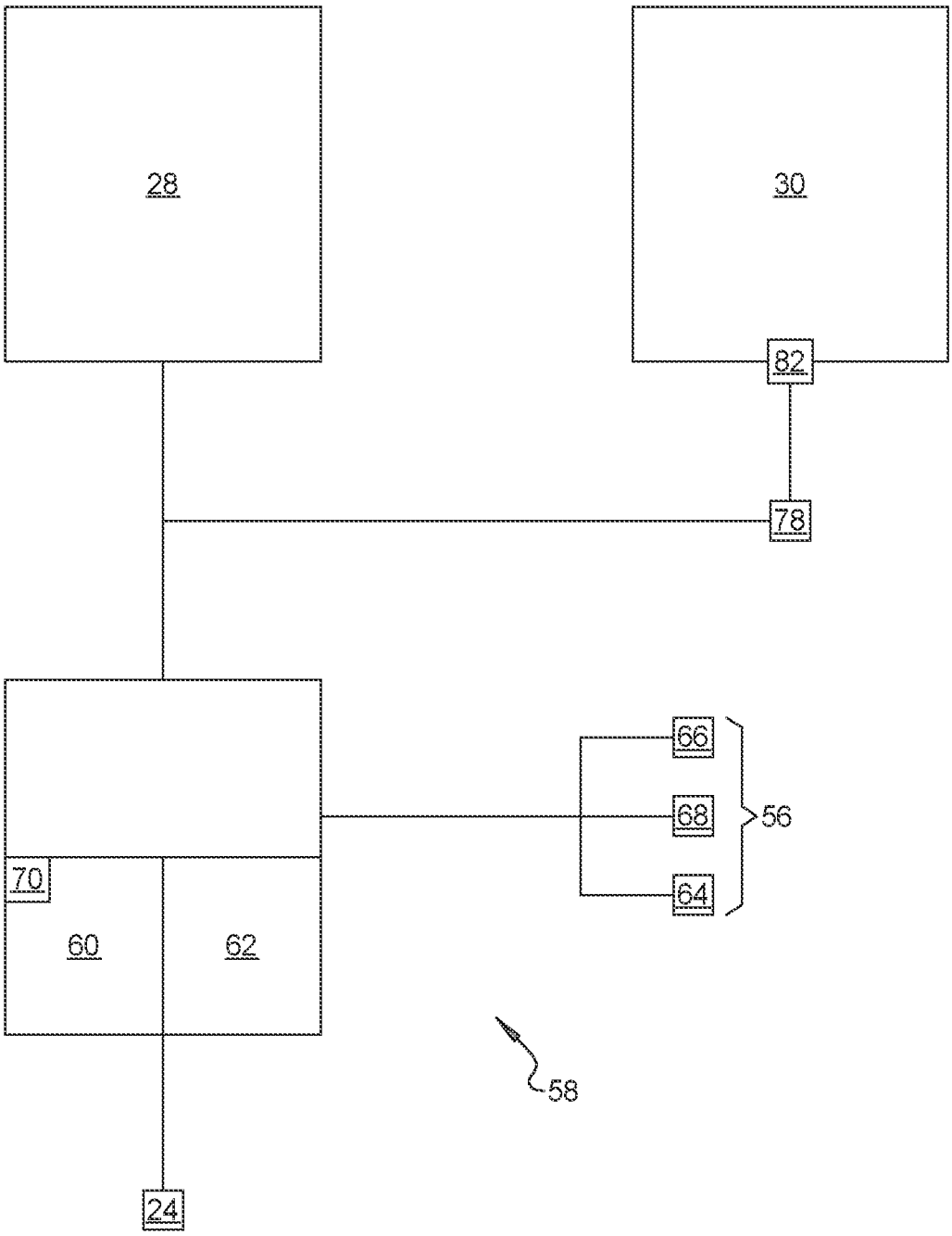
FIG. 5 is a schematic illustration including an example control circuit of the example cordless railroad spike puller of FIG. 1.
Figure 6:
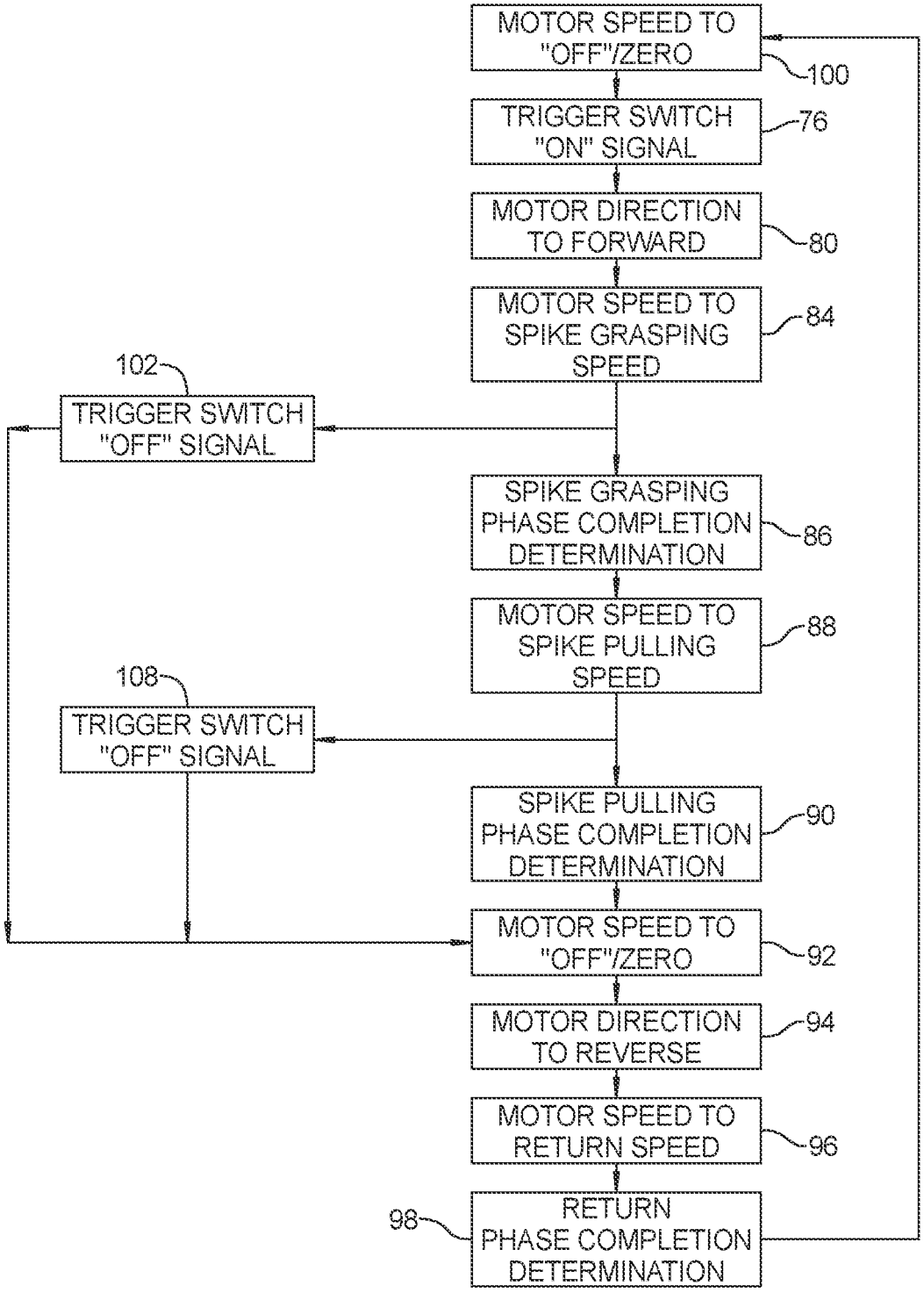
FIG. 6 is a flow chart of one example of an overall tool or spike pulling cycle of the example cordless railroad spike puller of FIG. 1.

Example embodiments will now be described more fully with reference to the accompanying drawings.

With reference to FIGS. 1-6, one example embodiment of a cordless railroad spike puller 20 in accordance with the present disclosure is illustrated and described herein. The cordless spike puller 20 can include a pair of handles 22, at least one of which includes a manually actuatable trigger switch 24. The cordless spike puller 20 can include at least one battery mount 26. As in this example, the cordless spike puller 20 can have two battery mounts 26. In addition, the battery mount or mounts 26 can each be located at the end of one of the handles 22. Each battery mount 26 can be configured to mechanically and electrically releasable couple a rechargeable battery 28 to the spike puller 20.

A drive motor 30 can be drivingly coupled to a threaded drive shaft 32, e.g., using Acme threads, through a gearbox 36 having a non-impact gear train 34. Using a non-impact gear train 34 can reduce unnecessary vibrations that could otherwise be transmitted to the operator, causing operator fatigue. In addition, battery life can be increased, due to the lack of an impact mechanism, which can increase tool and operator efficiency. The gearbox 36 can also have a two speed gear train 34 that includes a high speed gear path 38 and a low speed gear path 40.

A manually actuatable gear speed knob or switch 42 can be mounted to the tool housing. The manually actuatable gear speed switch 42 can be operably coupled to the two-speed gear train 34 to selectively drivingly couple the motor to the drive shaft 32 through the high speed gear path 38 in a high speed position, and through the low speed gear path 40 in a low speed position. Thus, the operator can choose to operate the tool in a higher speed, lower power gear or gear path 38, to reduce extraction or cycle time when this provides sufficient to pull a railroad spike. The operator can choose to operate the spike puller tool 20 in a lower speed, higher power gear or gear path 40 when a stubborn spike is encountered that requires extra power to pull.

The threaded drive shaft 32 can be coupled to a non-rotating pull rod 52 through a coupling 46 that includes a threaded collar or nut 48. A set of spike puller jaws 50 can be operably coupled to the distal end of the pull rod 52. The pull rod 52 can include a central bore or cavity 54 into which the threaded drive shaft 32 moves as the coupling 46 and pull rod 52 are driven toward the proximal end of the drive shaft 32 during a spike pulling operation.

The spike puller 20 can include one or more pull rod position sensors 56 coupled to a controller or control circuit 58. The control circuit 58 can include a microprocessor 60 and memory 62. As an example, three pull rod position sensors 56 can be provided. These can be a bottom or extended position sensor 64, a top or retracted position sensor 66, and an intermediate, speed change position sensor 68. As examples, each of the pull rod position sensors 56 can be a magnetic switch or a hall effect sensor.

As other examples, the extended position sensor 64 and the retracted position sensor 66 can be pressure, contact, or strain sensors that detect when the coupling 46 engages a lower dampener 72 and an upper dampener 74, respectively. In an example, the intermediate speed change sensor 68 can be replaced by the control circuit 58 can include a clock circuit 70 and can be configured to change the speed after a predetermined lapse in time of operation of the spike puller 20 from the initiation of a spike pulling operation, or from the extended position sensor 64 indicating the pull rod 52 has moved out of its bottom or extended position.

In another example, a single pull rod position sensor 66, such as a rotation sensor, can enable the control circuit 58 to keep track of the rotational position or revolutions of the drive shaft 32. In this way, the control circuit 58 can keep track of the axial position of the pull rod 52 that is threadably mounted on the drive shaft 32. In yet another example, the control circuit 58 can use the lapse of operational time to keep track of the axial position of the pull rod 52, which can not only eliminate the need for the speed change position sensor 68, but can also eliminate the need for, or minimize the reliance on, the extended position sensor 64 and the retracted position sensor 66. For example, a single one of the pull rod position sensors 56 can be provided to allow the control circuit 58 to periodically confirm or adjust the position of the pull rod 52 that is being calculated and stored in the memory 62.

Figure 8:
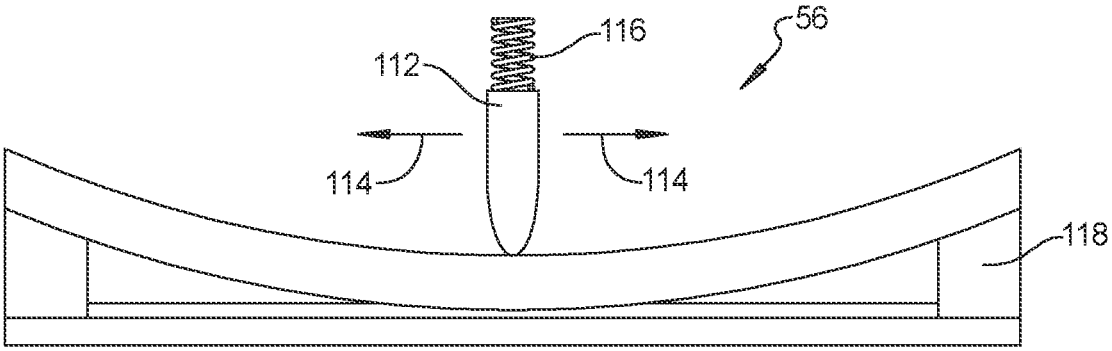
FIG. 8 is an illustration of the elongated position sensor of FIG. 7.
Figure 9:
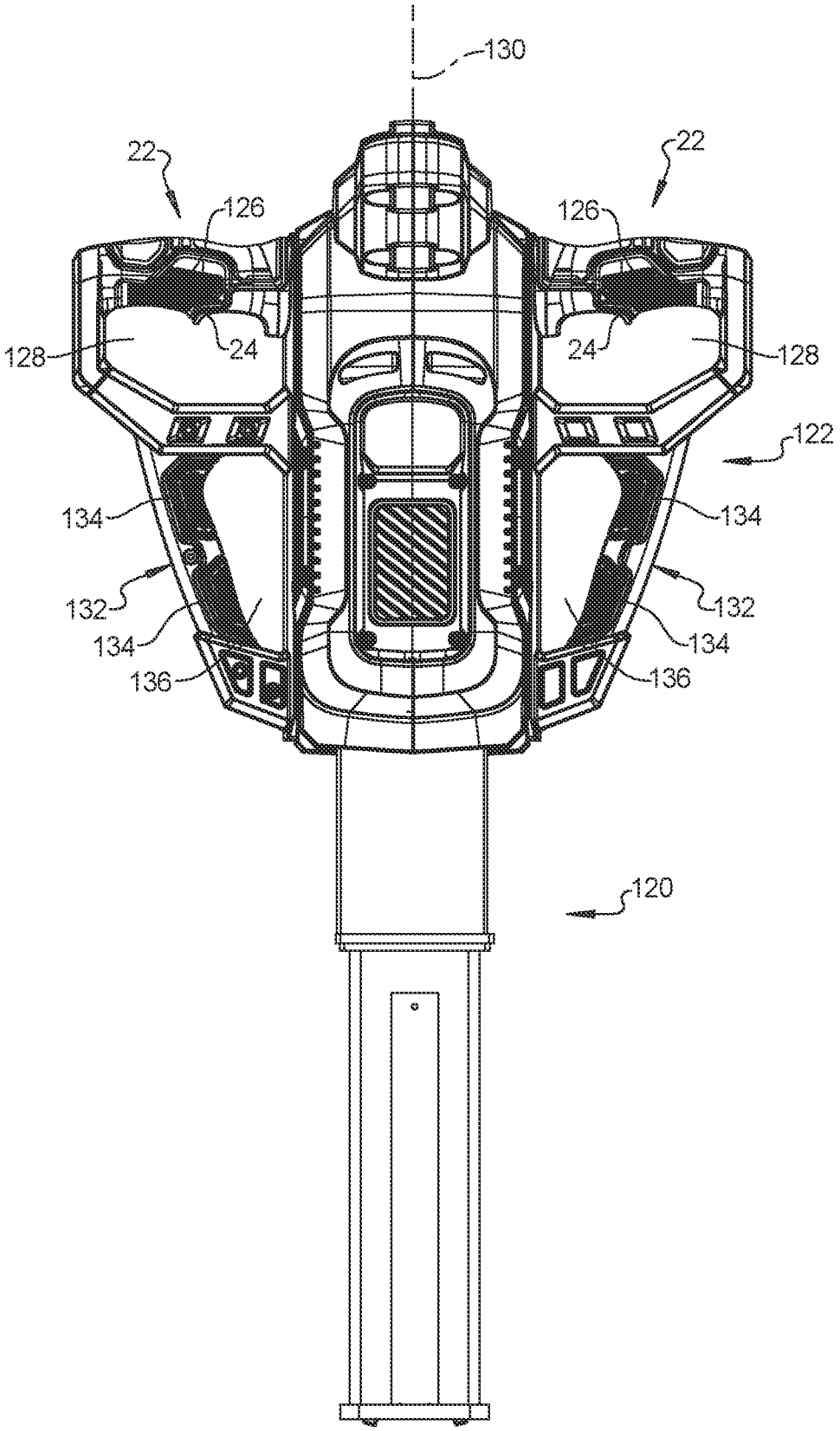
FIG. 9 is an elevation view including one example of a plastic housing that includes both a pair of operating handles and a pair of carrying handles of a cordless railroad spike puller in accordance with the present disclosure.
Figure 10:
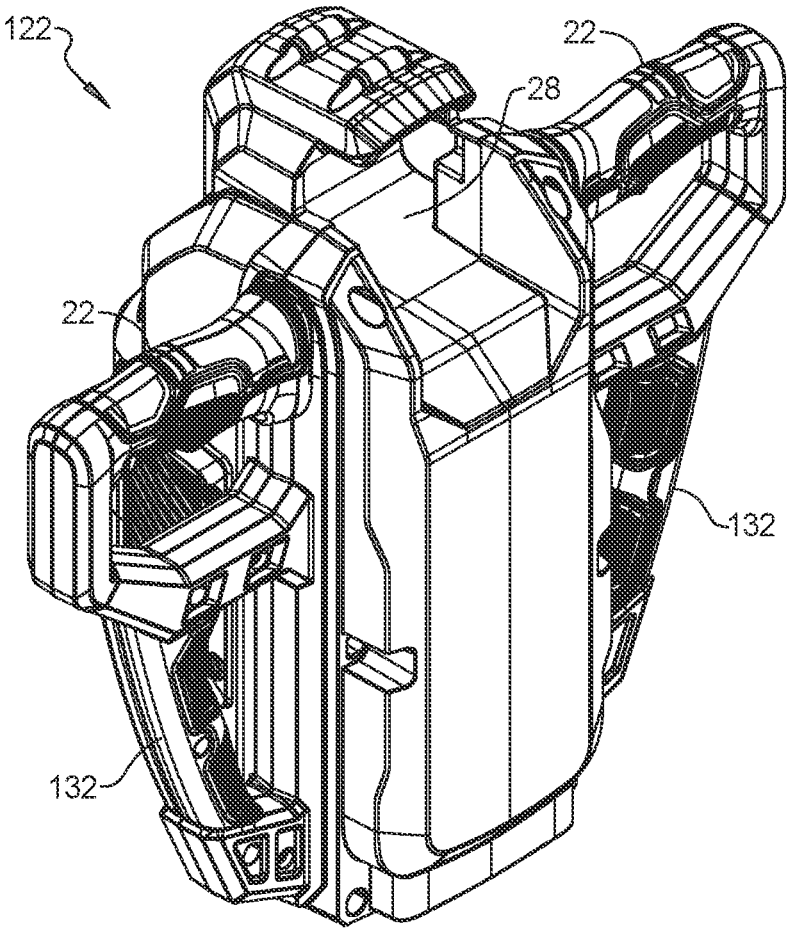
FIG. 10 is a perspective view of the example of the plastic housing of FIG. 9.

Referring to FIGS. 8 and 9, a single pull rod position sensor 56 can have an elongated or linear shaped sensor body 118. The sensor body 118 can be coupled to and can extend longitudinally along an interior surface 110 of the railroad spike puller 20. The position sensor 56 can include a sensor wiper 112 that can be coupled to the pull rod 52. For example, the wiper 112 can be coupled to the pull rod 52 via a collar (not shown) or via the coupling 46. The wiper 112 can extend from the pull rod 52 to move along a longitudinal path 114 of wiper engagement with the sensor body 118 as the non-rotating pull rod 52 moves between the extended position and the retracted position.

A spring 116 can bias the wiper 112 against the sensor body 118. Based on the longitudinal position along the longitudinal path 114 at which the wiper is engaging the single position sensor 56, the single position sensor 56 can provide the control circuit 58 any of an extended position signal indicating the pull rod 52 is in the extended position, a speed change signal indicating the pull rod 52 is in a predetermined position corresponding to the end of a spike grasping phase, a retracted position signal indicating the pull rod 52 is in the retracted position, or any combination of these signals. Examples of such a linear single pull rod position sensor 56 include the Hotpot position sensors of Spectra Symbol Corp. of Salt Lake City, Utah.

Returning to FIGS. 1-6, an operation cycle of the spike puller 20 begins and ends with the pull rod 52 in its extended position (FIG. 3) and motor speed set to "off" (Box 100). The control circuit 58 can be configured, in response to receipt of an "on" signal (Box 76) from manual activation of the trigger switch 24 by an operator to place or move a motor direction selector switch 78 into the forward direction (Box 80) or the microprocessor 60 can change a direction control by sending a signal to a motor controller 82 corresponding to the forward state. In one example, the forward and reverse direction signals can involve setting a signal to "open" (e.g., a reference voltage) for one of the two directions and to "closed" (e.g., zero volts) for the other of the two directions. In some cases, setting the motor direction to forward (Box 80) can occur after setting the motor speed to "off" (Box 100) and before receiving an "on" signal from the trigger switch (Box 76). As used herein, the "forward direction" of rotation of the motor means the direction the motor rotates to cause the non-rotating pull rod and spike puller jaws to move toward a retracted position. The "reverse direction" of rotation of the motor means the direction the motor rotates to cause the non-rotating pull rod and spike puller jaws to move toward an extended position.

The microprocessor 60 can also set or send a motor speed signal to the motor controller 82. In one example, the motor speed signal can involve adjusting a signal voltage from zero percent to 100 percent of a reference voltage, with zero volts corresponding to a motor "off" state. The controller 58 can be configured to set the motor speed to an initial low speed or grasping mode speed (e.g., 50%) during the initial low speed or spike grasping mode, phase, or period (Box 84).

The control circuit 58 can be configured to make a spike grasping phase completion determination (Box 86). The low speed phase or period can correspond to the coupling 46 and pull rod 52 moving axially a predetermined grasping distance that is sufficient for the jaws 50 to seat around and grab a spike that the spike puller 20 has been positioned over for pulling. For example, this predetermined axial grasping distance that the coupling 46, nut 48, and pull rod 52 move can be approximately two inches or so.

In response to the control circuit 58 determining that this initial low speed or spike grasping phase has reached completion (Box 86), the control circuit 58 can be configured to operate the motor 30 in a high speed mode (e.g. 100%) during a main high speed or spike pulling mode, phase, or period (Box 88). For example, the control circuit 58 can be configured to make this spike grasping phase completion determination, upon receipt of a signal from the speed change sensor 68, or upon the lapse of a predetermined period of motor operating time from the initiation of the spike grasping phase.

Initially operating the motor 30 in a low speed mode during a short initial spike grasping phase can increase the repeatability and reliability of the jaws 50 properly closing on and grasping the spike. For example, the predetermined axial grasping distance that the coupling 46, nut 48, and pull rod 52 move during the spike grasping phase can be about two inches in some cases. Thereafter operating the motor 30 in a high speed mode throughout the much longer axial distance or main spike pulling phase can meaningfully reduce the overall cycle time without negatively affecting spike grasping. For example, the axial distance that the coupling 46, nut 48, and pull rod 52 move during the main spike pulling phase can be about 6, or 7, or 8 inches in various cases.

The control circuit 58 can be configured to make a spike pulling phase completion determination (Box 90). For example, the controller 58 can be configured to make this determination upon receiving a signal from the retracted position sensor 66 indicating the coupling 46, nut 48, and pull rod 52 are in their retracted positions. Additionally, the controller can be configured to make the spike pulling phase completion determination (Box 90), in response to receiving a trigger switch "off" signal during the spike pulling phase as indicated in Box 108 or during the spike grasp as indicated in Box 102.

In response to the control circuit 58 determining that the main high speed or spike pulling phase has reached completion, the control circuit 58 can be configured to automatically temporarily switch the motor 30 to "off" without regard to the position or state of the trigger switch 24 (Box 92). Subsequently, and again without regard to the position or state of the trigger switch 24, the control circuit 58 can be configured to automatically set the motor direction to reverse (Box 94) and then to restart the motor 30 in reverse at a return (e.g., 100%) speed (Box 96). In response, the coupling 46, nut 48, and pull rod 52 are moved toward their extended positions or initial cycle starting position. The control circuit 58 can be configured to make a return phase completion determination (Box 98). Again, without regard to the position or state of the trigger switch 24, the control circuit 58 can automatically switch the motor 30 to "off" (Box 100) upon determining that the coupling 46, nut 48, and pull rod 52 have returned to their extended positons.

As in this example, the control circuit 58 can be configured to operate automatically after making the spike pulling phase completion determination (Box 90). This determination can automatically initiate the automatic return phase above, including turning the motor 30 "off" (Box 92), operating the motor 30 in high or full speed reverse (Box 96), making the return phase completion determination (Box 98) and again turning the motor 30 "off" at the completion of the spike pulling or tool cycle (Box 100).

Because this automatic return phase can proceed without intervention or action by the operator, the operator can focus on other activities during this automatic return period (Boxes 92, 94, 96, 98, and 100). For example, the operator can focus on the process of moving and positioning the spike puller 20 over the next spike the operator desires to pull with the spike puller 20. The operator is able to accomplish this without regard to where or how he is grasping the spike puller 20, and without needing to manually reverse the direction of the motor 30, or needing to keep his finger on the trigger 24. Thus, the automatic return phase can provide a reduced effective cycle time for the operator, due to the automatic return phase part of the actual cycle time occurring independent of the operator. This can lead to reduced physical and mental operator fatigue, and to increased spike pulling productivity of the operator and spike puller 20 during a given period of time.

In response to a subsequent activation of the trigger switch 24 (Box 76) by the user, the control circuit 58 can once again initiate the spike puller or tool cycle, beginning with the spike grasping mode.

The terms "automatic," "automatically," etc., as used herein mean that these actions occur without the need for any action or intervention by an operator. For example, during the automatic return phase (Boxes 92, 94, 96, and 98) the controller can even be configured to ignore any signals received from the trigger switch 24. In this example, however, the controller can be configured to respond to signals received from the trigger switch 24, including an off signal, as indicated during the spike grasping phase (Box 102 would flow to Box 90) and during the spike pulling phase (Box 108 would flow to Box 90).

As described above, the control circuit 58 can send commands, such as motor speed signals, to the motor controller 82 as analog voltage levels. The control circuit 58, however, is not limited to analog motor control. The control circuit 58 can use digital, time-varying motor control, such as pulse width modulation, or an intelligent communications control to manage the motor subsystem.

In some cases, the control circuit 58 can be configured to stop or turn the motor "off" in various circumstances. For example, the control circuit 58 can be configured to set the motor speed to zero upon the lapse of a predetermined period of time from the initiation or starting of the motor 30 in the spike grasping phase, in the motor pulling phase, and in the automatic return phase. The predetermined period of time can be the same or different for these phases. As another example, the control circuit 58 can be configured to monitor the current draw for the motor 30 and to stop or turn the motor "off" if the current draw reaches or exceeds a predetermined current draw limit. As another example, the control circuit 58 can be configured to set the motor speed to zero if the control circuit 58 fails to receive any signals from a sensor, indicating a sensor failure, e.g., of the pull rod position sensors 56.

Figure 7:
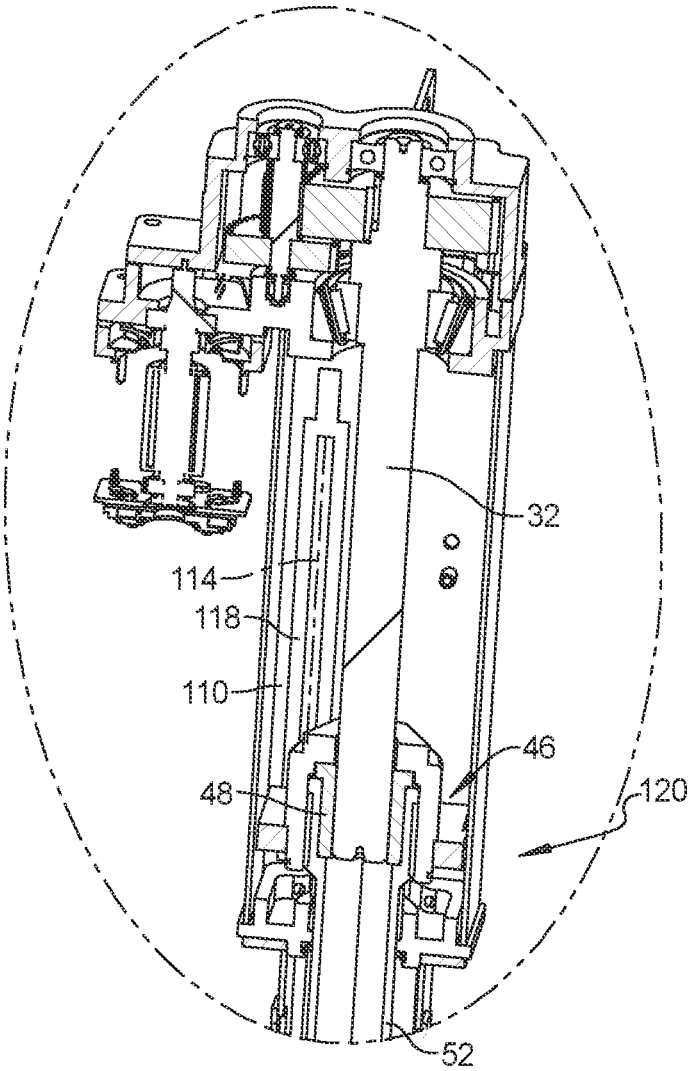
FIG. 7 is a fragmented cross-section view including one example of a single pull rod position sensor that has an elongated or linear shaped sensor body of a cordless railroad spike puller in accordance with the present disclosure.

FIG. 9 illustrates another example tool housing and handle arrangement. In FIG. 9, and in FIGS. 7 and 8, the same reference numbers are used to identify and describe corresponding elements or features in each of the various examples of this disclosure, even if the corresponding elements or features are not identical. In addition, the descriptions of various corresponding elements or features provided herein with respect to FIGS. 1-6 may not be duplicated with respect to FIGS. 7-9 and vice versa, despite its applicability, to reduce or avoid unnecessary repetition thereof.

As illustrated in FIG. 9, the spike puller 20 can include a linearly extending metal portion 120 within in which the threaded drive shaft 32, the pull rod 52, and the spike puller jaws 50 can be housed. The spike puller 20 can also include a plastic housing 122 coupled to the metal portion 120. The housing 122 can be comprised of molded plastic material. The housing 122 can include a pair of operating handles 22. One or more manually operable trigger switches 24 can be coupled to the operating handles 22 of the housing 122. Each operating handle 22 can include an operating manual gripping portion 126 that can be oriented and designed to enable a user to ergonomically operate the manually operable trigger switches 24 while supporting the spike puller 20 during a spike pulling operation in an operating orientation. In the operating orientation, the threaded drive shaft 32 and the non-rotating pull rod 52 can extend in an upright operating direction.

The operating manual gripping portions 126 of the pair of operating handles 22 can each border an opening 128 that extends through the plastic material of the housing 122. The plastic material of the housing 122 can fully surround each opening 128 that the operating manual gripping portions 126 border. With the axis of rotation 130 of the threaded drive shaft 32 extending vertically, the operating manual gripping portions 126 can, in some cases, be oriented to extend at an angle from horizontal that less than 25 degrees, in some cases, less than 20 degrees, in some cases, less than 15 degrees, and, in some cases, less than 10 degrees.

The housing 122 can include a pair of carrying handles 132. Each carrying handle 132 can include a carrying manual gripping portion 134 that can be oriented and designed to enable a user to ergonomically carry the spike puller 20 in an operating orientation. In the carrying orientation, the threaded drive shaft 32 and the non-rotating pull rod 52 can extend in a side-laying carrying direction.

The carrying manual gripping portions 134 of the pair of carrying handles 132 can each border an opening 136 that extends through the plastic material of the housing 122. The plastic material of the housing 122 can fully surround each opening 136 that the carrying manual gripping portions 134 border. With the axis of rotation 130 of the threaded drive shaft 32 extending vertically, the carrying manual gripping portions 134 can in some cases, be oriented to extend at an angle from vertical that less than 25 degrees, in some cases, less than 20 degrees, in some cases, less than 15 degrees, and, in some cases, less than 10 degrees. In other example embodiments, the operating manual gripping portion 126 of the operating handle 22 and the carrying manual gripping portion 134 of the carrying handle 132 on each side of the spike puller 20 can border a common or single opening, instead of separate openings 128 and 136.

As used herein, an "upright operating direction" means the threaded drive shaft 32 and the non-rotating pull rod 52 extend in a direction that is more vertical than it is horizontal. In contrast, a "side-laying carrying direction" means the threaded drive shaft 32 and the non-rotating pull rod 52 extend in a direction that is more horizontal than it is vertical.

Various methods within the scope of the present disclosure should be apparent from the discussion herein. In some cases for example, such methods can include providing, assembling, configuring, or operating one or more of the features or components of a cordless railroad spike pulling tool 20 in one or more of the various ways described and illustrated herein. This can include for example, operating, or configuring the controller or control circuit 58 to operate, one or more components of a cordless railroad spike pulling tool 20 in one or more of the various ways described and illustrated herein, including the operator grasping the tool without actuating the trigger and moving the tool to another location during the automatic return phase or period or engaging in other activities during this period.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cordless railroad spike puller comprising:

a drive motor and a threaded drive shaft with a gear train operably coupling the drive motor to the threaded drive shaft;

spike puller jaws with a non-rotating pull rod coupling the threaded drive shaft to the spike puller jaws;

a battery mount selectively couplable to a rechargeable battery to provide electric power to the drive motor, wherein rotation of the drive motor in a forward direction rotates the gear train and the threaded drive shaft to move the non-rotating pull rod and the spike puller jaws toward a retracted position within the cordless railroad spike puller, and rotation of the drive motor in a reverse direction rotates the gear train and the threaded drive shaft to move the non-rotating pull rod and the spike puller jaws toward an extended position within the cordless railroad spike puller;

a control circuit operably coupled to the drive motor, wherein the control circuit comprises a microprocessor and a memory;

a manually actuatable trigger switch coupled to the control circuit; and a pull rod position sensor coupled to the control circuit and the pull rod position sensor being operable to provide at least one of an extended position signal to the control circuit in response to the non-rotating pull rod and the spike puller jaws being in the extended position, and a retracted position signal to the control circuit in response to the non-rotating pull rod and the spike puller jaws being in the retracted position, wherein the control circuit is configured to operate the drive motor in the forward direction at a spike grasping motor speed during a spike grasping phase in response to an "on" signal from the manually actuatable trigger switch, and the control circuit is configured to operate the drive motor in the forward direction at a spike pulling motor speed, which is faster than the spike grasping motor speed, during a spike pulling phase upon completion of the spike grasping phase, and wherein the pull rod position sensor is operable to provide a speed change signal to the control circuit in response to the non-rotating pull rod moving a predetermined grasping distance from the extended position that enables the spike puller jaws to seat around and grab a railroad spike, and the control circuit is configured to operate the drive motor in the forward direction at the spike pulling motor speed in response to the speed change signal from the pull rod position sensor.

2. The cordless railroad spike puller of claim 1, wherein the gear train is a non-impact gear train.

3. The cordless railroad spike puller of claim 1, wherein the control circuit is configured to operate the drive motor in the forward direction at the spike pulling motor speed during the spike pulling phase upon completion of the spike grasping phase independent of the manually actuatable trigger switch.

4. The cordless railroad spike puller of claim 3, wherein the control circuit is configured to operate the drive motor in the reverse direction at a return motor speed, which is faster than the spike grasping motor speed, during an automatic return phase in which the non-rotating pull rod and the spike puller jaws move toward the extended position, upon completion of the spike pulling phase.

5. A cordless railroad spike puller comprising:

a drive motor and a threaded drive shaft with a gear train operably coupling the drive motor to the threaded drive shaft;

spike puller jaws with a non-rotating pull rod coupling the threaded drive shaft to the spike puller jaws;

a battery mount selectively couplable to a rechargeable battery to provide electric power to the drive motor, wherein rotation of the drive motor in a forward direction rotates the gear train and the threaded drive shaft to move the non-rotating pull rod and the spike puller jaws toward a retracted position within the cordless railroad spike puller, and rotation of the drive motor in a reverse direction rotates the gear train and the threaded drive shaft to move the non-rotating pull rod and the spike puller jaws toward an extended position within the cordless railroad spike puller;

a control circuit operably coupled to the drive motor, wherein the control circuit comprises a microprocessor and a memory;

a manually actuatable trigger switch coupled to the control circuit; and a pull rod position sensor coupled to the control circuit and the pull rod position sensor being operable to provide at least one of an extended position signal to the control circuit in response to the non-rotating pull rod and the spike puller jaws being in the extended position, and a retracted position signal to the control circuit in response to the non-rotating pull rod and the spike puller jaws being in the retracted position, wherein the control circuit is configured to automatically operate the drive motor in the reverse direction at a return motor speed during an automatic return phase in which the non-rotating pull rod and the spike puller jaws move toward the extended position, and the control circuit is configured to ignore any signal from the manually actuatable trigger switch during the automatic return phase.

6. The cordless railroad spike puller of claim 5, wherein the control circuit is configured to operate the drive motor in the reverse direction at the return motor speed during the automatic return phase in response to the pull rod position sensor providing the retracted position signal to the control circuit.

7. The cordless railroad spike puller of claim 5, wherein the control circuit is configured to operate the drive motor in the reverse direction at the return motor speed during the automatic return phase in response to the manually actuatable trigger switch providing an "off" signal to the control circuit.

8. The cordless railroad spike puller of claim 5, wherein the control circuit is configured to turn the drive motor "off," ending the automatic return phase, in response to the pull rod position sensor providing the extended position signal to the control circuit.

9. The cordless railroad spike puller of claim 1, wherein the gear train comprises a dual speed gear train comprising a high speed gear path, and a low speed gear path, and a manually actuatable gear speed switch operably coupled to the dual speed gear train to selectively drivingly couple the drive motor to the threaded drive shaft through the high speed gear path in a high speed switch position, and to selectively drivingly couple the drive motor to the threaded drive shaft through the low speed gear path in a low speed switch position.

10. The cordless railroad spike puller of claim 1, wherein a plurality of separate sensors comprise the pull rod position sensor.

11. The cordless railroad spike puller of claim 10, wherein the plurality of separate sensors comprise a retracted position sensor, an extended position sensor, and a speed change position sensor.

12. The cordless railroad spike puller of claim 1, wherein a single sensor comprises the pull rod position sensor.

13. A cordless railroad spike puller comprising:

a drive motor and a threaded drive shaft with a gear train operably coupling the drive motor to the threaded drive shaft;

spike puller jaws with a non-rotating pull rod coupling the threaded drive shaft to the spike puller jaws;

a battery mount selectively couplable to a rechargeable battery to provide electric power to the drive motor, wherein rotation of the drive motor in a forward direction rotates the gear train and the threaded drive shaft to move the non-rotating pull rod and the spike puller jaws toward a retracted position within the cordless railroad spike puller, and rotation of the drive motor in a reverse direction rotates the gear train and the threaded drive shaft to move the non-rotating pull rod and the spike puller jaws toward an extended position within the cordless railroad spike puller;

a control circuit operably coupled to the drive motor, wherein the control circuit comprises a microprocessor and a memory;

a manually actuatable trigger switch coupled to the control circuit; and a pull rod position sensor coupled to the control circuit and the pull rod position sensor being operable to provide at least one of an extended position signal to the control circuit in response to the non-rotating pull rod and the spike puller jaws being in the extended position, and a retracted position signal to the control circuit in response to the non-rotating pull rod and the spike puller jaws being in the retracted position, wherein the single pull rod position sensor includes a sensor body that extends longitudinally along an interior surface of the cordless railroad spike puller, and a wiper that is coupled to the non-rotating pull rod and extends to move along a longitudinal path of wiper engagement with the sensor body as the non-rotating pull rod moves between the extended position and the retracted position.

14. The cordless railroad spike puller of claim 1, wherein the non-rotating pull rod translates relative to the threaded drive shaft as the non-rotating pull rod and the spike puller jaws move between the retracted and extended positions.

* * * * *